US006588093B1

(12) United States Patent
Emmerich et al.

(10) Patent No.: US 6,588,093 B1
(45) Date of Patent: Jul. 8, 2003

(54) METHOD AND DEVICE FOR PRODUCING BUNDLES OF SHEET METAL LAMINATES FOR MAGNETIC CORES

(75) Inventors: Kurt Emmerich, Alzenau (DE); Alois Hangg, Otterstadt (DE); Herbert Hein, Freigericht (DE); Markus Widrig, Wangen (CH); Jörg Lüscher, Einsiedeln (CH)

(73) Assignees: Vacuumschmelze GmbH, Hanau (DE); FAES Werkzeug-und-Maschinenbau Aktiengesellschaft, Wollerau (CH)

( * ) Notice: Subject to any disclaimer, the term of this patent is extended or adjusted under 35 U.S.C. 154(b) by 0 days.

(21) Appl. No.: 09/508,954

(22) PCT Filed: Sep. 14, 1998

(86) PCT No.: PCT/DE98/02723

§ 371 (c)(1),
(2), (4) Date: Mar. 17, 2000

(87) PCT Pub. No.: WO99/16092

PCT Pub. Date: Apr. 1, 1999

(30) Foreign Application Priority Data

Sep. 19, 1997 (DE) ..... 197 41 364

(51) Int. Cl.[7] ..... H01F 3/04

(52) U.S. Cl. ..... 29/609; 29/564.7; 29/564.2

(58) Field of Search ..... 29/609, 607, 830, 29/33 M, 564.7, 564.2

(56) References Cited

U.S. PATENT DOCUMENTS

| | | | | |
|---|---|---|---|---|
| 4,494,101 A | | 1/1985 | Buchschmid et al. | |
| 4,897,916 A | | 2/1990 | Blackburn | |
| 5,075,150 A | * | 12/1991 | Webb et al. | 428/162 |

FOREIGN PATENT DOCUMENTS

| | | |
|---|---|---|
| CH | 648 950 | 4/1985 |
| DE | AS 1 242 747 | 6/1967 |
| DE | OS 1 811 585 | 7/1969 |
| DE | AS 1 948 771 | 9/1969 |
| DE | AS 25 30 309 | 5/1978 |
| DE | 7 621 081 | 7/1978 |
| DE | OS 32 27 681 | 2/1984 |
| DE | OS 35 35 573 | 4/1987 |
| DE | PS 35 00 530 | 12/1989 |
| DE | 295 14 508 | 12/1995 |
| EP | 0 100 871 | 2/1984 |
| EP | 0 184 563 | 6/1986 |
| EP | 0 133 858 | 9/1986 |
| EP | 0 304 343 | 2/1989 |
| EP | 0 671 750 | 9/1995 |
| EP | 0 738 831 | 10/1996 |
| GB | 2 105 523 | 3/1983 |
| GB | 2 226 459 | 6/1990 |
| JP | 9-213543 | 8/1997 |

* cited by examiner

*Primary Examiner*—Edward K. Look
*Assistant Examiner*—Michael Leslie
(74) *Attorney, Agent, or Firm*—Schiff Hardin & Waite

(57) ABSTRACT

In a manufacturing method and apparatus for manufacturing sheet metal packets in punch-packeting technology with a round or oval iron cross section. laminations are punched from a ribbon and are provided with depressions at one side and with elevations at the other side that coincide with the depressions and lie opposite them, with the elevations being in the form of at least two circular nipples being pressed into the depressions upon assembly of each packet. In one lamination per packet, serving as a separating lamination, cylindrical holes are punched instead of the depressions, the nipples of the neighboring lamination engaging into these holes. Laminations are thereby punched from the strip that respectively exhibit different outside contours, particularly different widths, and are joined with one another to form a packet that has a cross-section that is at least partially round, by virtue of the sheet metal packet having graduated edges.

11 Claims, 3 Drawing Sheets

FIG. 1
(PRIOR ART)
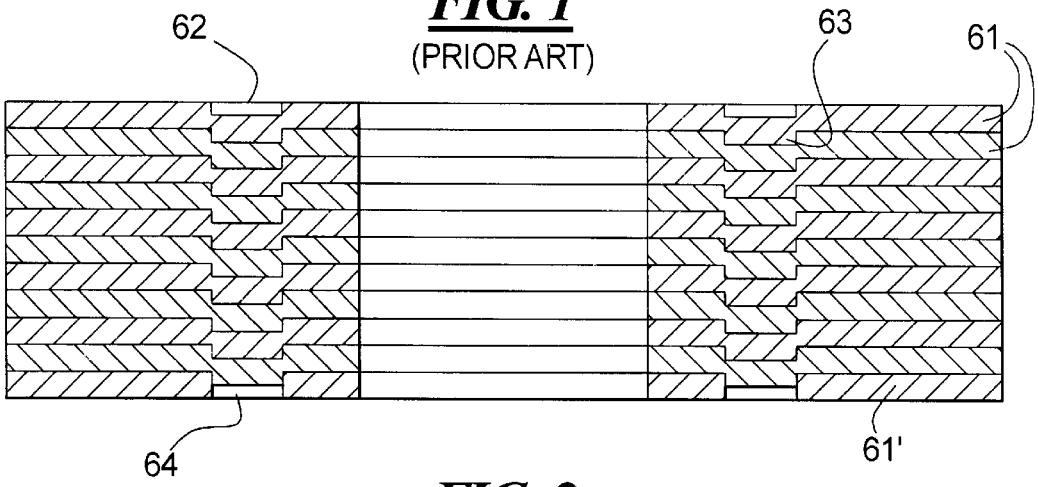
FIG. 2
(PRIOR ART)
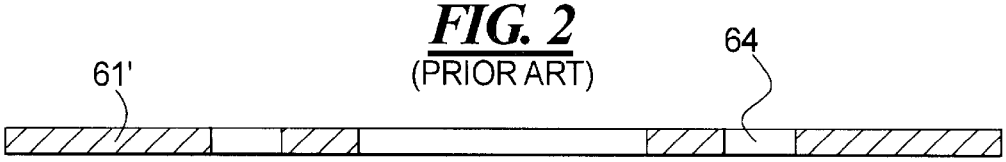
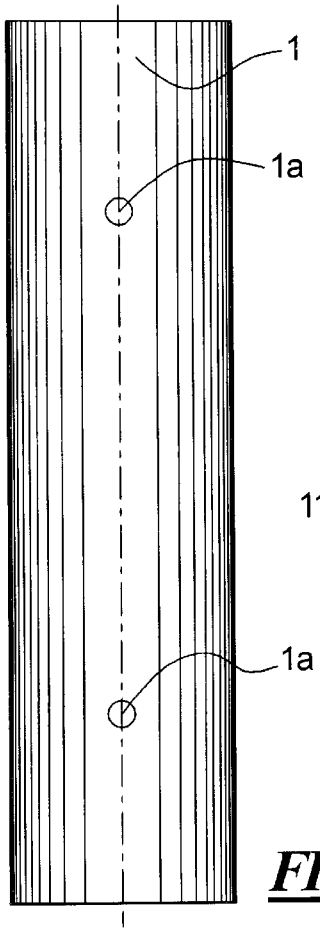
FIG. 4
FIG. 3
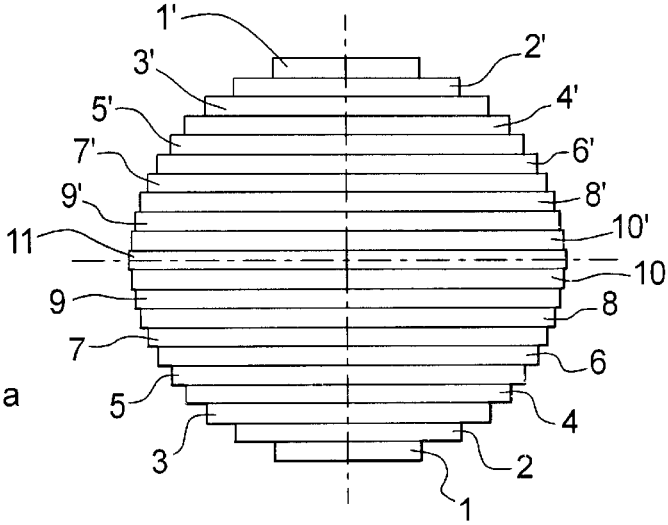

FIG. 7
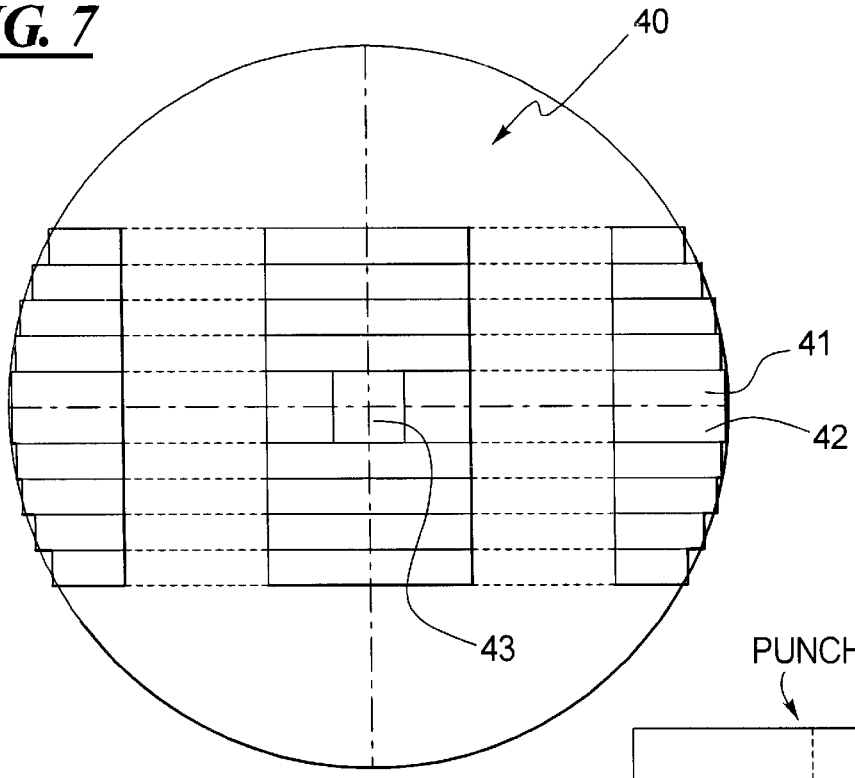
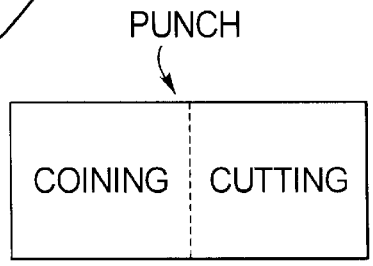
FIG. 9
FIG. 8
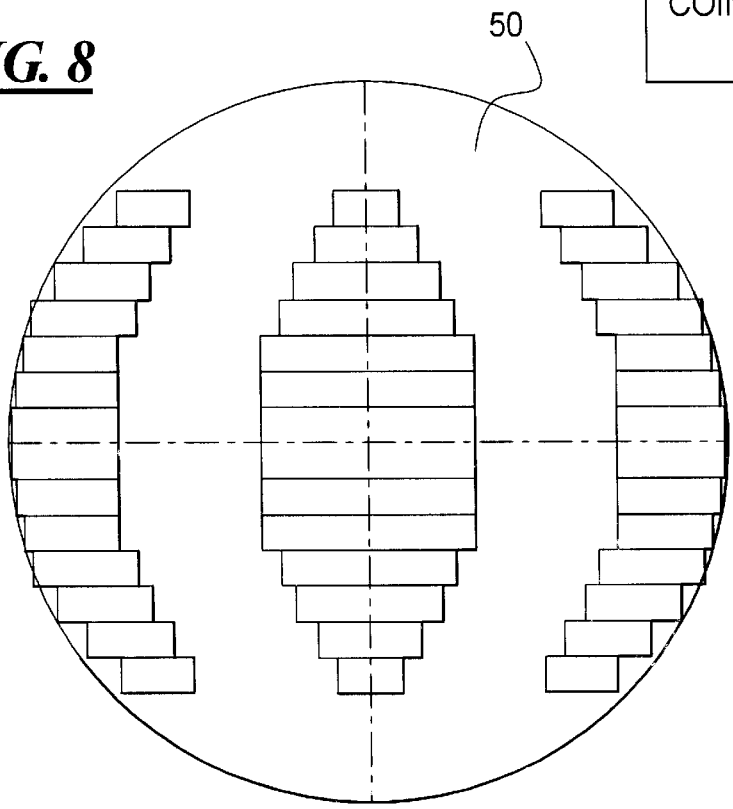

METHOD AND DEVICE FOR PRODUCING BUNDLES OF SHEET METAL LAMINATES FOR MAGNETIC CORES

BACKGROUND OF THE INVENTION

1. Field of the Invention

The invention is directed to a method for manufacturing packets composed of linked sheet metal laminations for magnetic cores, known as sheet metal packets.

2. Description of the Prior Art

A method is disclosed in European Application 0 133 858 for manufacturing such sheet metal packets, laminations wherein are punched from a tape and are provided with depressions at one side and with elevations at the other side that coincide with the depressions and lie opposite them. In the form of at least two circular nipples these elevations are pressed into the depressions upon assembly of each packet. Instead of the depressions, cylindrical holes are punched into one lamination per sheet metal packet, this serving as parting lamella. The nipples of the neighboring laminations engage into these circular holes. The teachings of European Application are expressly incorporated herein by reference.

Among other things, sheet metal packets of this type are used in various electromagnetic apparatus such as, for example, inductors, transformers, actuating drives, actuators such as, for example, solenoid valves, etc.

The employment of sheet metal packets in magnetic circuits has been state of the art for many years and serves the purpose of reducing eddy currents that, for example, in transformers, contribute to an increase in the losses or, given solenoid valves, contribute to a lengthening of the switching times. As an alternative to sheet metal packets, toroidal tape cores are employed that, however, exhibit the disadvantage compared to sheet metal packets that the coils required for the drive must be slipped on before closing the magnetic circuit.

Due to the requirement of a rectangular iron cross section in sheet metal packets, in many instances the use of sheet metal packets cannot be optimized. In many applications, for example, it is desirable to keep the recesses for the sheet metal packets to be introduced round or, oval.

When a sheet metal packet having a rectangular iron cross section is then introduced into such a round or, oval recess, the comparatively low iron cross section relative to the diameter of the recess is disadvantageous. This disadvantage becomes particularly serious when the conditions of use require a miniaturization of the components, as is particularly necessary in internal combustion engines.

SUMMARY OF THE INVENTION

It is therefore an object of the present invention to provide a manufacturing method of the above type wherein sheet metal packets are also available that have a round or oval iron cross section.

This is inventively achieved by a method for manufacturing packets composed of linked sheet metal laminations for magnetic cores wherein laminations are punched from a tape and are provided with depressions at one side and are provided with projections at the other side that coincide with the depressions and lie opposite them, wherein the projections in the form of at least two circular nipples and are pressed into the depressions upon assembly of each packet, wherein cylindrical holes instead of the depressions are punched in one lamination per packet, this serving as separating a lamination, the nipples of the neighboring lamination engaging thereinto. Laminations are thereby punched from the band that respectively have different outside contours and are linked with one another to form a packet that at least partially has a round iron cross section. Accordingly, the sheet metal packet has graduated edges.

As a result of this measure, sheet metal packets can be fabricated that have their outside contour adapted to a round shape and whose iron cross section corresponds to the ideal circular shape to more than 95%.

Typically, laminations are thereby punched from the tape that have respectively different widths. These laminations of different widths are then linked to form a packet that has a nearly circular iron cross section.

In an alternative embodiment of the inventive method, E-shaped laminations are punched from the tape, their outside and/or middle leg exhibiting different widths. Due to the variation of the widths of the middle leg sheets, middle legs can be manufactured whose iron cross section nearly corresponds to the ideal circular shape. As a result, it is possible to slip circular coils onto the middle leg. Due to the variation of the widths of the outside leg sheets, the arising sheet metal packets can in turn be adapted to the circular or oval installation requirements.

An extremely high work output with only a single apparatus is achieved when the depressions and the nipples of each lamination are flow-coined with dies given simultaneous application of opposing force with counter-dies, whereby the nipple diameter is greater than that of the corresponding depression, and the nipple height is less than the depth of the corresponding depression, which has achieved at least 50% of the lamination thickness.

The depressions and the nipples are preferably flow-coined for at most another 10 ms by the dies after the counter-dies have reached their final position.

In an embodiment of the present invention, the nipple diameters are formed at most 20 $\mu$m larger than the diameter of the corresponding depression, and the nipple height is formed at most 0.1 mm less than the depth of the corresponding depression.

Further, the laminations can be pre-coined or pre-punched at the rated locations of the depressions and the nipples.

The inventive apparatus for the implementation of the method has at least two dies and two counter-dies, that are height-adjustable in the matrix, in the coining station which produces the depressions and the nipples. Each counter-die is provided with a collar for defining its limit position at the support of the matrix; Braking elements are installed in the cut-out station of the finished lamination under the matrix, these braking elements proceeding transversely relative to the counter-die axes and exerting the required resistance in the joining of the individual, finished laminations to one another. Cutting dies that can be moved apart and moved into one another in turn in defined steps are located in the cut-out station. This setting of the cutting dies to different widths typically ensues automatically with an actuating drive.

DESCRIPTION OF THE DRAWINGS

FIG. 1 is a sectional view of a packet of conventionally formed laminations.

FIG. 2 is a sectional view of a conventionally formed separating lamination, for use in the packet of FIG. 1.

FIG. 3 is a side view of a packet of inventively formed laminations.

FIG. 4 is a plan view of an inventively formed separating lamination for use in the packet shown in FIG. 3.

FIG. 7 is a side view of a packet of inventively formed E-shaped laminations with an opening in a central region thereof.

FIG. 8 is a side view of a packet of inventively formed laminations adapted to a round shape, in a further embodiment.

FIG. 9 schematically illustrates a punch operable in accordance with the inventive method.

DESCRIPTION OF THE PREFERRED EMBODIMENTS

Figure 5:
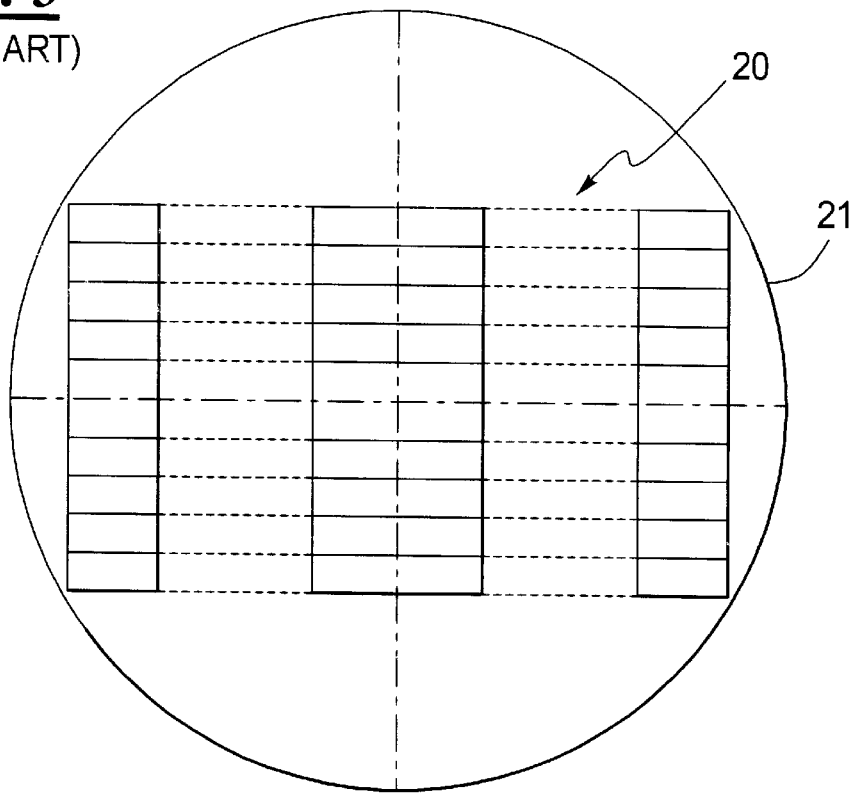
FIG. 5 (PRIOR ART)
FIG. 5 is a side view of a packet of conventionally formed E-shaped laminations.

According to the prior art, laminations 61 are punched from a punch tape and layered on top of one another in a successor tool with a plurality of work stations in order to form packets. According to the prior art, identical laminations 61 are thereby provided with depressions 62 at the one side in the successor tool and are provided with nipples 63 coinciding with the depressions 62 and lying opposite them at the other side. Upon assembly of each packet, at least two circular nipples 63 are pressed into the corresponding depressions 62. In each packet, one lamination that serves as separating lamination 61' is provided with cylindrical holes 64 instead of being provided with depressions. The nipples 63 of the neighboring laminations then engage into these holes 64. This is schematically shown in FIG. 1. FIG. 2 shows a separating lamination 61' in cross section.

As proceeds from FIGS. 3 and 4, identical laminations are now no longer punched in the same successor tool according to the present invention; rather, the sheet metal widths are varied after the introduction of the nipples. By controlling the sheet stamping apparatus, the width of the sheet metal laminations that are punched out is reset after every punching step by lateral displacement of the cutter die. In the exemplary embodiment shown in FIG. 3, a narrow lamination whose width amounts to approximately 30% of the desired diameter of the packet is punched first. This narrow lamination serves as separating lamination 1 and has two cylindrical holes 1*a*. The two cylindrical holes 1*a* are centrally punched and their diameter amounts to approximately 10% of the packet diameter. Nipples of the neighboring lamination 2 are pressed into these cylindrical holes. Before the next punching stroke of the tool, the cutter die is shifted under motor drive to the width of the next sheet metal. This next lamination 2 constitutes approximately 50% of the width of the coil core. In the same stamping apparatus, depressions are introduced into this lamination 2 at the one side and nipples 3 are introduced therein at the other side that coincide with the depressions 2 and lie opposite them. Subsequently, the laminations 3 through 11 are then analogously linked to one another with increasing width.

As described above, the aforementioned procedure takes place in a punch as schematically indicated in FIG. 9, with the production of the nipples taking place by coining, and the laminations being separated by cutting.

For the laminations 10' through 1' that now follow, the lateral cutting dies are then in turn successively moved together, so that the packet shown in FIG. 3 and in FIG. 4 can be removed from the stamping apparatus as finished part.

In this way, it is possible, for example, to manufacture a cylindrical coil core for a round ignition coil that fills up a large part of the cross sectional area of the circle.

The following table 1 describes embodiments wherein a rod core having a diameter of 30 mm was manufactured of laminations with different thicknesses according to the method according to the invention. The iron cross section has thereby been measured compared to a sheet metal packet having rectangular iron cross section.

TABLE 1

| Band Thickness [mm] | Iron Cross Section, Round Sheet Metal Packet (%) | Iron Cross Section Rectangular Sheet Metal Packet (%) |
|---|---|---|
| 1.5 | 93 | 63 |
| 1.0 | 95 | 64 |
| 0.7 | 97 | 64 |
| 0.5 | 98 | 64 |
| 0.3 | 99 | 64 |

Cylindrical coil cores of 0.5 mm thick grain-oriented iron silicon were manufactured with the invention method, these varying in diameter from 5 mm through 20 mm.

FIG. 5 shows a EK core 20 having a rectangular iron cross section according to the prior art. Such EK cores are employed as actuators for diesel injection valves. The object here was to fabricate a EK core that can be screwed into a limited installation volume and that can achieve a high force level. The EK core 20 shown in FIG. 5 thereby exhibits only inadequate results since the area utilization of the round outside contour 21 for the iron cross section amounts to only 31%.

Figure 6:
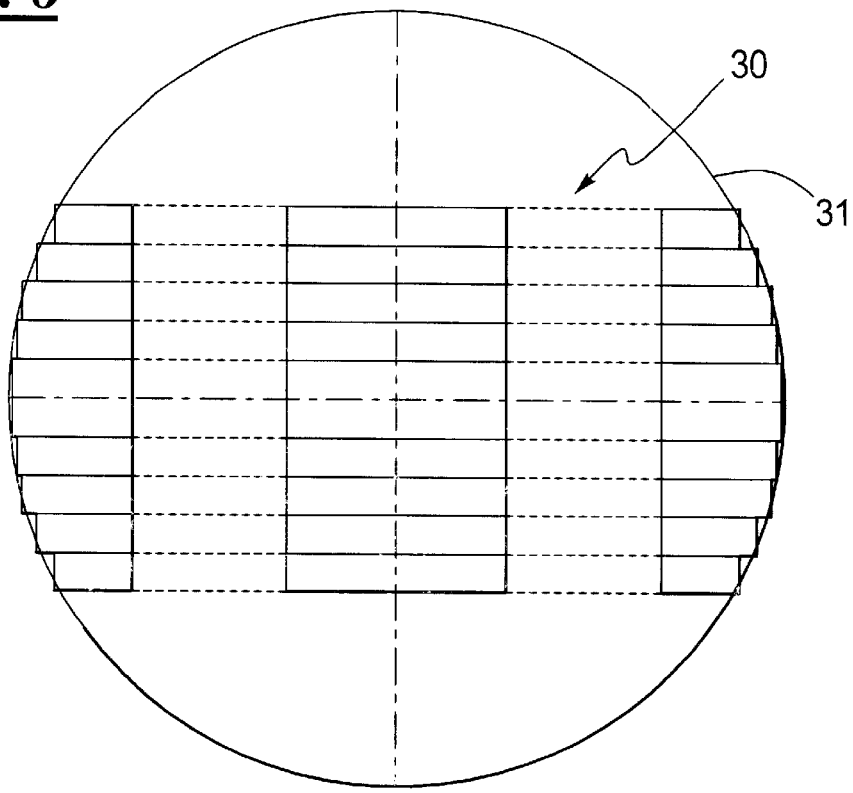
FIG. 6 is a side view of a packet of inventively formed E-shaped laminations.

With the inventive method, the round EK core 30 shown in FIG. 6 was adapted to the round outside contour 31. The operation of the stamping apparatus proceeds as in the fabrication of the cylindrical coil cores shown in FIGS. 3 and 4, namely by shifting the cutting die. The round EK core 30 of the inventive embodiment shown in FIG. 6 has an essentially higher area utilization compared to the EK core 20 of FIG. 5. An approximately 20% higher area utilization was thereby achieved.

The sheet metal packets were again manufactured of iron silicon and compared to sheet metal packets of the prior art. An increase in the force level of the magnetic circuit of 20% was achieved in the actuator for a diesel injection valve.

FIG. 7 shows an EK core 40 according to the present invention having a clearance at the middle leg. Such a core having a central clearance, but without the inventive features described herein, is known from German Utility Model 2951 4508. The teachings of German Utility Model 2951 4508 is expressly incorporated herein by reference. For the middle laminations 41, 42, a recess 43 is provided toward the middle, so that a central guidance for the valve rod (not shown) is enabled in the utilization. In this application, too, the force level was capable of being increased by 19% compared to a comparable sheet metal packet having a rectangular iron cross section. The illustrated EK core 40 is again composed of grain-oriented iron silicone.

In the optimization of the EK core 40 shown in FIG. 7 with contours rounded at the outside, the limitation of the utilization of the circular area is defined by the width of the outer sheet metal layers. A further optimization can inventively ensue in that the inner cutting die of the successor joining tool required for the manufacture of cores is also shifted under motor drive. As a result, the middle leg of the sheet metal packet is rounded and, consequently, adequate space is created for the outer layers so that a punch-oriented joining in the tool is still possible.

FIG. 8 shows a sheet metal packet 50 adapted to the round shape, whereby a 44% larger iron cross sectional area is achieved compared to the sheet metal packet of FIG. 6 having a rectangular iron cross section.

A corresponding sheet metal packet 50 in an installation space of 20 mm composed of laminations of 1 mm thick iron silicon achieved a force of 78 N instead of 54 N compared to a sheet metal packet 40 having rectangular iron cross section.

Although modifications and changes may be suggested by those skilled in the art, it is the intention of the inventors to embody within the patent warranted hereon all changes and modifications as reasonably and properly come within the scope of their contribution to the art.

What is claimed is:

1. A method for manufacturing packets of linked sheet metal laminations for a magnetic core, comprising the steps of:

successively punching a plurality of laminations from a sheet metal strip including, for each of said laminations, punching a depression at a first side of each lamination and a projection at a second, opposite side of each lamination, said depressions and projections coinciding with each other in position;

forming said projections as at least two circular nipples on each lamination and pressing said at least two circular nipples into respective depressions in an adjacent lamination to stack said laminations in a packet;

in each packet, in one lamination, punching only cylindrical holes and disposing said one lamination at one side of said packet as a separating lamination, with said at least two circular nipples of an adjacent lamination engaging said cylindrical holes; and successively cutting said laminations from said strip with respectively different widths and joining said laminations to form said packet with a substantially round cross-section.

2. A method as claimed in claim 1 comprising punching said laminations from said strip with respectively different widths and joining said laminations in said packet with a lamination having a largest width at a center of said packet and laminations having smallest widths at a top and a bottom of said packet, respectively, to form said round cross-section.

3. A method as claimed in claim 1 comprising punching said laminations from said strip with a E-shape so that each lamination has exterior legs and a middle leg, and punching said laminations from said strip with said exterior legs in different laminations having different widths.

4. A method as claimed in claim 1 comprising punching said laminations from said strip with a E-shape so that each lamination has exterior legs and a middle leg, and punching said laminations from said strip with said middle leg in different laminations having different widths.

5. A method as claimed in claim 1 comprising punching said laminations from said strip with a E-shape so that each lamination has exterior legs and a middle leg, and punching said laminations from said strip with said exterior legs and middle leg in different laminations having different widths.

6. A method as claimed in claim 1 comprising flow coining the respective depressions and nipples in each lamination using dies with simultaneously applied opposing forces in counter-dies, to form each nipple with a nipple diameter of each nipple which is larger than the depression and with a nipple height of each nipple which is smaller than a depth of the depression, and which is at least 50% of a thickness of the lamination.

7. A method as claimed in claim 6 comprising flow coining said nipples in each lamination for an additional time, up to and including 10 ms, between said dies and said counter-dies after said dies and said counter-dies reach a limit position.

8. A method as claimed in claim 6 comprising forming said nipples with said nipple diameter being larger than said depression by at most 20 $\mu$m, and with said nipple height being smaller than said depth of said depression by at most 0.1 mm.

9. A method as claimed in claim 6 comprising pre-coining each lamination at intended locations of the depressions and the nipples.

10. An apparatus for manufacturing packets of linked sheet metal laminations for a magnetic core, comprising:

a punch which punches a plurality of laminations from a sheet metal strip including, for each of said laminations, producing a depression at a first side of each lamination and a projection at a second, opposite side of each lamination, said depressions and projections coinciding with each other in position;

said punch forming said elevations as at least two circular nipples on each lamination and pressing said at least two circular nipples into respective depressions in an adjacent lamination to stack said laminations in a packet;

said punch in each packet, in one lamination, punching only cylindrical holes and disposing said one lamination at one side of said packet as a separating lamination, with said at least two circular nipples of an adjacent lamination engaging said cylindrical holes; and said punch cutting said laminations from said strip with respectively different widths and joining said laminations to form said packet with a substantially round cross-section.

11. An apparatus as claimed in claim 10 having a plurality of work stations, including a coining station for forming said projections and depressions, said coining station comprising at least two dies and height-adjustable counter-dies, each of said counter-dies having a collar for determining a limit position, and braking elements proceedingly transversely relative to respective axes of said counter-dies for providing a resistance for joining said laminations in said packet.

* * * * *